US007357687B1

(12) United States Patent
Gornstein et al.

(10) Patent No.: US 7,357,687 B1
(45) Date of Patent: Apr. 15, 2008

(54) MARINE PROPULSION STEERING SYSTEM

(75) Inventors: Robert Gornstein, Kailua, HI (US); Gary Shimozono, Kapolei, HI (US); Brian Kays, Kaneohe, HI (US)

(73) Assignee: Navatek, Ltd., Honolulu, HI (US)

( * ) Notice: Subject to any disclaimer, the term of this patent is extended or adjusted under 35 U.S.C. 154(b) by 0 days.

(21) Appl. No.: 11/647,164

(22) Filed: Dec. 29, 2006

(51) Int. Cl.
*B63H 5/15* (2006.01)

(52) U.S. Cl. ..... 440/67

(58) Field of Classification Search ..... 114/166; 440/67

See application file for complete search history.

(56) References Cited

U.S. PATENT DOCUMENTS

| | | | | |
|---|---|---|---|---|
| 44,696 A | | 10/1864 | Ressel | |
| 119,584 A | * | 10/1871 | De Man | 114/166 |
| 189,603 A | | 4/1877 | Carpenter | |
| 711,884 A | | 10/1902 | Sjostrom | |
| 2,139,594 A | | 12/1938 | Kort | 114/166 |
| 2,800,150 A | * | 7/1957 | Farwell, Sr. | 114/166 |
| 2,956,536 A | | 10/1960 | Kilvington | 115/35 |
| 3,179,081 A | * | 4/1965 | Backhaus et al. | 440/5 |
| 3,253,569 A | | 5/1966 | Serdar | 115/35 |
| 3,653,349 A | * | 4/1972 | Brown | 114/265 |
| 3,899,992 A | | 8/1975 | Fuller | 115/42 |
| 4,310,319 A | | 1/1982 | Fuller | 440/51 |
| 4,509,925 A | | 4/1985 | Wührer | 440/67 |
| 4,929,203 A | | 5/1990 | Hahn | 440/75 |
| 6,846,210 B1 | | 1/2005 | Abella | 440/67 |

* cited by examiner

*Primary Examiner*—Ed Swinehart
(74) *Attorney, Agent, or Firm*—Fitzpatrick, Cella, Harper & Scinto

(57) ABSTRACT

A marine propulsion steering apparatus includes a steering nozzle having a central opening therethrough which surrounds a marine propulsion drive shaft and propeller extending from a hull or propulsion module. The nozzle is pivotally mounted for angular movement in a predetermined range of movement on the support structure for the drive shaft for directing flow of water from the propeller in response to pivotal motion controlled by a steering mechanism.

10 Claims, 8 Drawing Sheets

MARINE PROPULSION STEERING SYSTEM

FIELD OF THE INVENTION

The prevent invention relates to marine propulsion steering systems, and more in particular to a steering system using an articulated nozzle mounted around the drive propeller of a ship's hull or propulsion pod.

BACKGROUND OF THE INVENTION

Marine steering systems have taken numerous forms over the years since power was first provided on water craft. These steering systems have included rudders, articulated drives, including articulated propellers, water jets and the like.

For example U.S. Pat. Nos. 4,929,203 and 3,253,569 disclose marine propeller drive systems in which a propeller is provided which can be pivoted from one position to another, port and starboard, to effectuate steering. U.S. Pat. Nos. 189,603 and 711,886 disclose older versions of this same concept, with the latter patent showing the propeller located within an articulated tube. U.S. Pat. No. 4,310,319 discloses a similar structure.

U.S. Pat. Nos. 6,846,210; 4,509,925; and 3,899,992 disclose propulsion systems with a fixed nozzle surrounding a drive propeller, and use a rudder or the like in the conventional manner for steering.

U.S. Pat. No. 2,139,594 discloses a steering drive for a marine propulsion system in which a nozzle is pivotally mounted for movement about a fixed drive propeller.

As seen from some of the above noted references, the use of a nozzle around a propeller in order to improve drive efficiency was first described many years ago and the modification of such nozzles to cause them to be moved with the propeller for steering purposes followed at about the same time. Generally, such nozzles have been attached to the vessels on which they are used in much the same way as rudders are, that is, with a steering shaft depending vertically upward and a pintle depending vertically downward to provide an axis of pivot for the nozzles, with bearings supporting both. This required direct attachment of the nozzle to the vessel.

OBJECTS OF THE INVENTION

It is an object of the present invention to provide a marine propulsion steering nozzle system which is relatively simple in construction and inexpensive in manufacture.

Yet another object of the present invention is to provide such a system which reduces the requirement for mounting appendages attached to the hull of a vessel.

A still further object of the present invention is to provide a marine propulsion steering nozzle system wherein the nozzle is mounted for rotation for steering on the drive shaft for its associated propeller for effectuating steering by redirecting water flow exiting the propeller.

SUMMARY OF THE INVENTION

In accordance with an aspect of the present invention a marine steering apparatus is provided which includes a steering nozzle having a central opening therethrough adapted to surround a marine propulsion drive shaft extending from a hull or a propulsion pod and the shaft's associated propeller. The steering nozzle is pivotally mounted on the drive shaft for the propeller for movement in a predetermined range of movement relative to the fixed propeller for directing a solid flow of water from the propeller for steering purposes.

In accordance with another aspect of the present invention the nozzle is supported by an elongated shaft support tube adapted to be secured to a ship's hull or propulsion pod with a nozzle support collar pivotally mounted on the shaft support tube and connected to the nozzle by at least one radially extending support arm, that arm being located in the path of water flow to the propeller behind it. In accordance with another aspect of the present invention a pair of such arms may be provided.

The above, and other objects, features and advantages of the invention would be apparent to those skilled in the art from the following detailed description of an illustrative embodiment of the invention wherein:

DETAILED DESCRIPTION OF THE DRAWINGS

Figure 1:
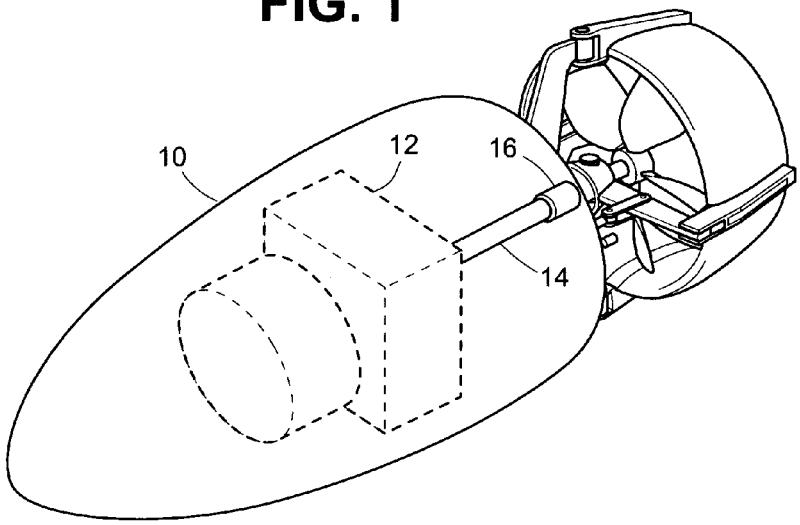
FIG. 1 is a perspective view of a propulsion pod or a water craft using the marine propulsion steering system of the present invention.
Figure 2:
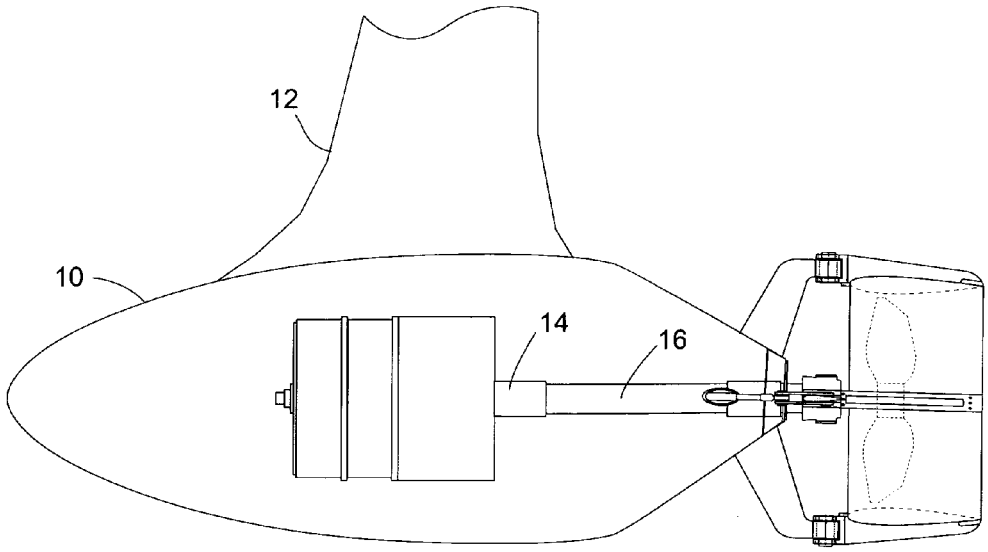
FIG. 2 is a side view of the pod shown in FIG. 1.

Referring now to the drawings in detail, and initially to FIGS. 1 and 2, a propulsion pod 10 adapted to be supported by a strut 12 from the hull of a water craft, such as shown in U.S. Pat. No. 6,263,819, includes a propulsion engine or motor 12 of conventional known construction, such as for example, an electrical motor or a diesel engine, which operates to drive a power output drive shaft 14 (shown in phantom lines in FIGS. 1 and 2). The drive shaft 14 is supported in an elongated bearing or sleeve 16 in any convenient manner. That sleeve extends rearwardly relative to the direction of travel of the vessel to which the propulsion pod is secured and extends through the rear end cap 18 and seal 20 at the aft end of the pod.

The marine propulsion steering system 30 of the present invention is mounted on a sleeve or stern tube 16, as described hereinafter, which extends out of pod 10.

Figure 3:
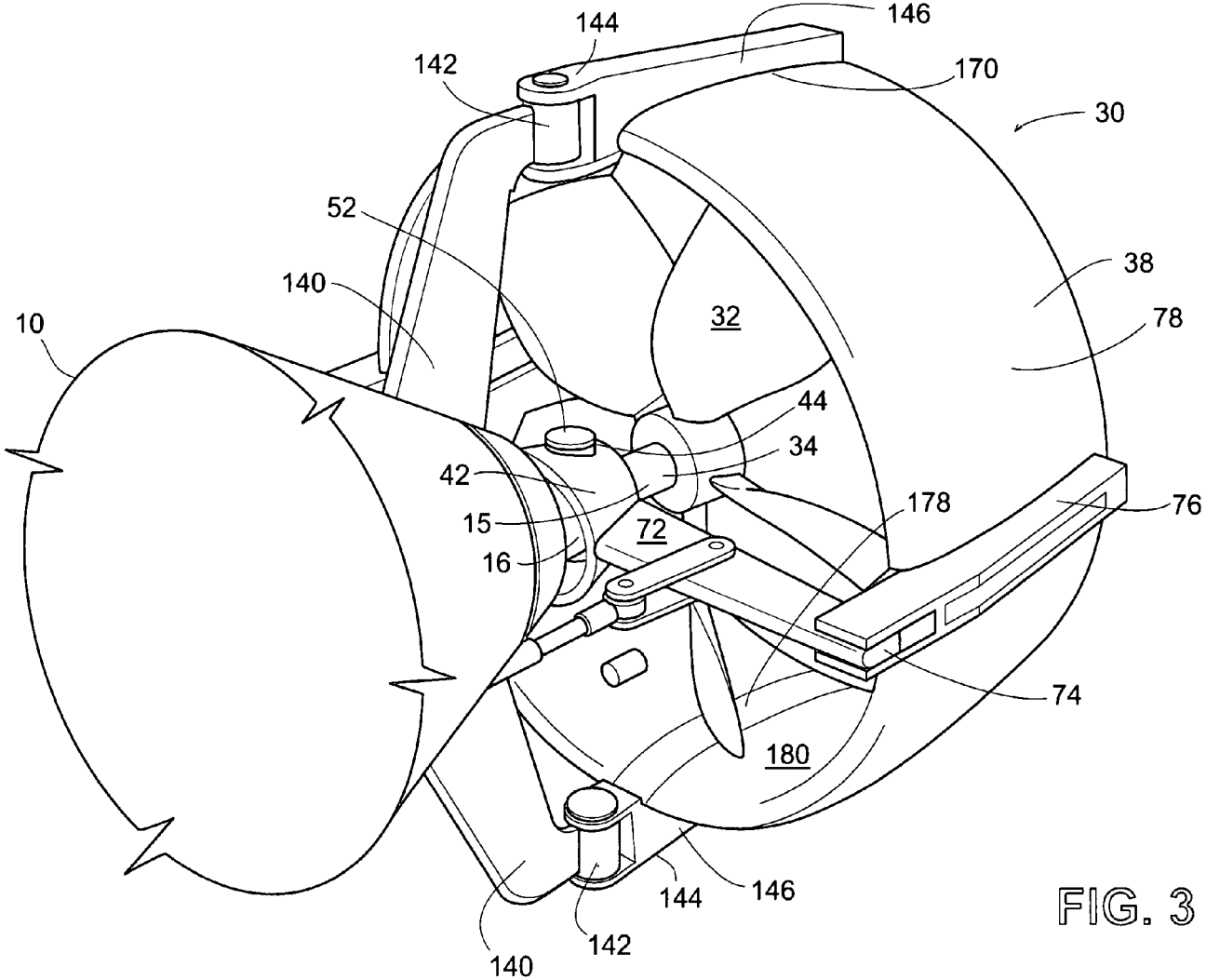
FIG. 3 is an enlarged perspective view of the aft end of the propulsion pod shown in FIG. 1.
Figure 4:
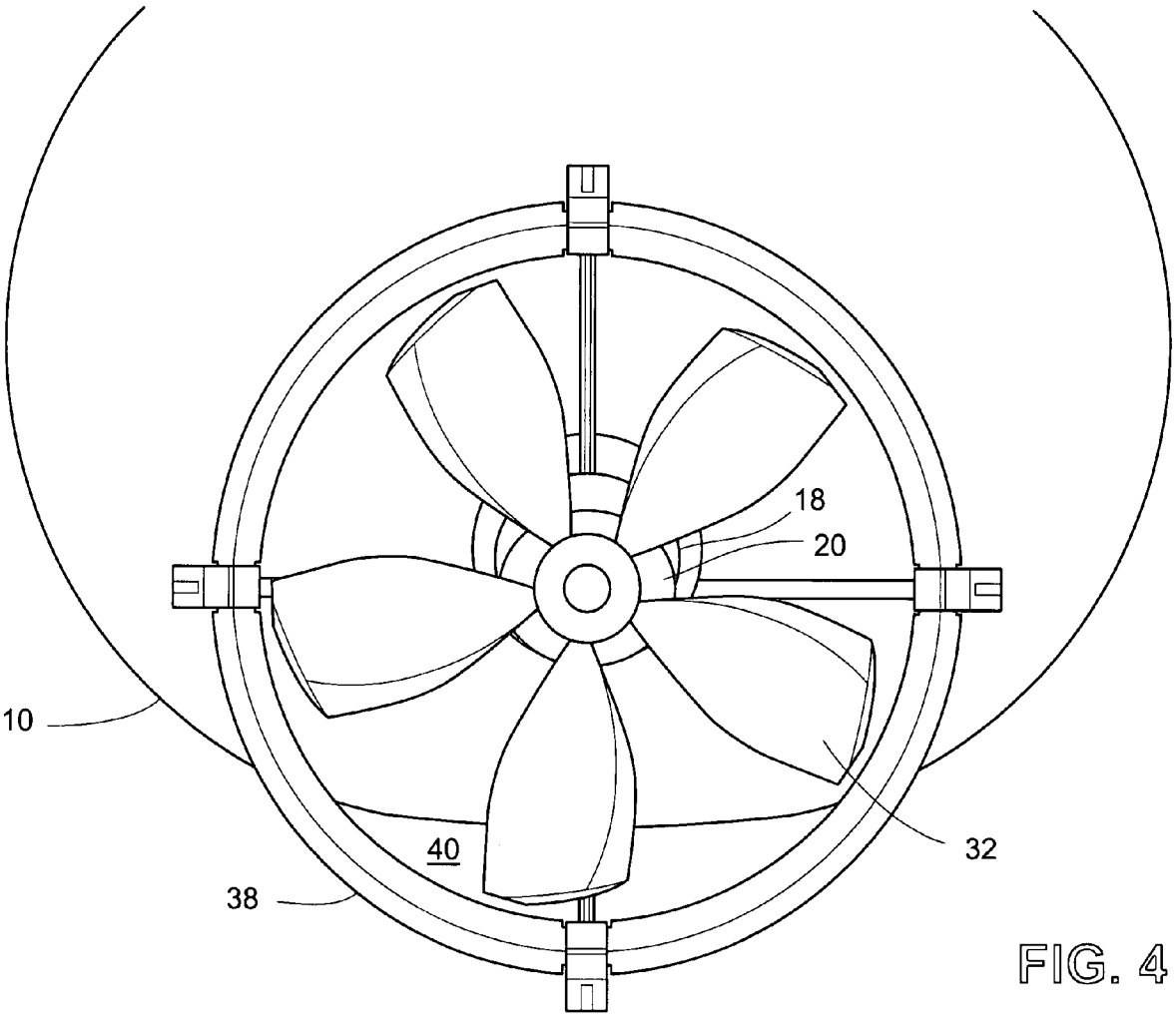
FIG. 4 is a rear view of the system shown in FIG. 3.
Figure 5:
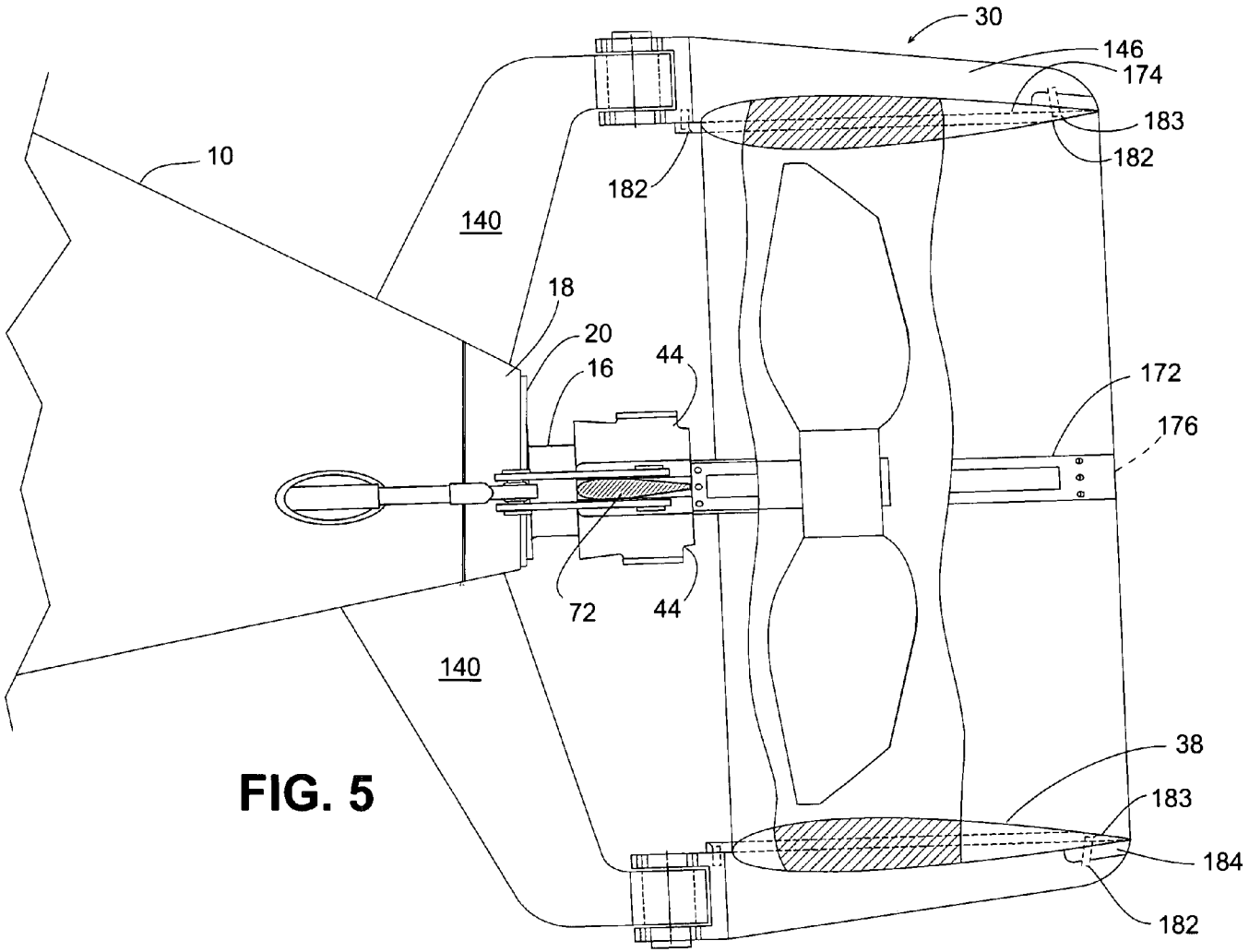
FIG. 5 is an enlarged side view, with parts broken away, of the propulsion steering nozzle system.
Figure 7:
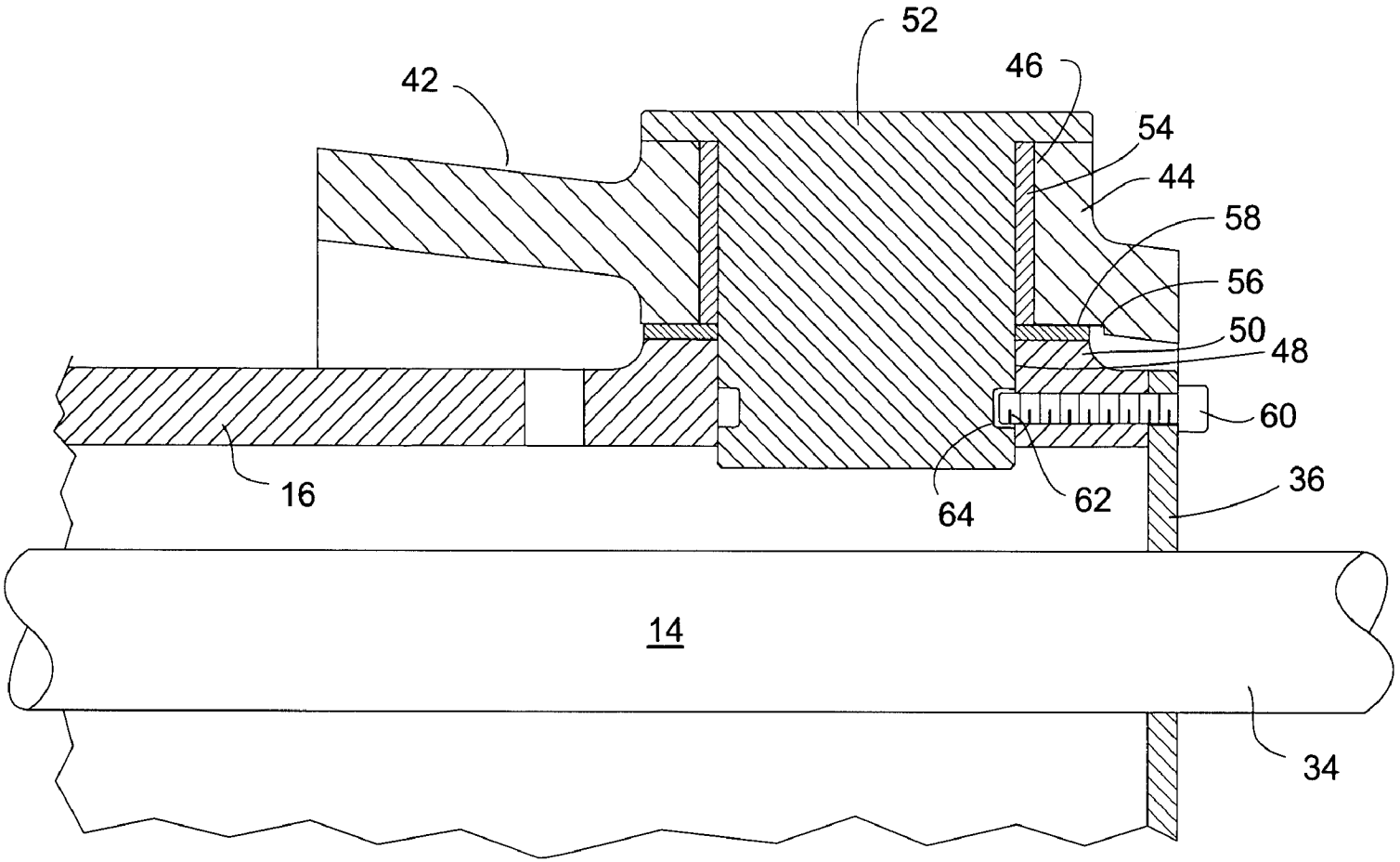
FIG. 7 is an enlarged partial sectional view of the pivotal arrangement for the mounting collar on the shaft support tube.

Referring now to FIGS. 3, 5 and 7, the system 30 includes a conventional marine propeller 32 mounted in any known or convenient manner on the end 34 of shaft 14 as would be apparent to those skilled in the art. As seen in FIG. 7 the end 34 of shaft 14 extends out of the sleeve 16 through an end seal or bushing 36 in any known manner to form a watertight seal between sleeve 16 and shaft 14.

A steering nozzle 38 having a central aperture 40 is provided in the steering assembly 30 to constrain the flow of water around and through the propeller in a restricted area and direct it as desired for steering. More specifically, nozzle 38 is pivotally mounted on sleeve 16, as described hereinafter, to pivot on a vertical axis relative to the direction of travel of the vessel and perpendicular to the shaft 14.

As seen most clearly in FIGS. 3 and 7, a central, generally cone shaped collar 42 is provided around sleeve 16 extending from propulsion pod 10. Collar 42 includes a pair of diametrically opposed bosses 44 formed thereon which provide the pivotal mounting connection of the collar to the sleeve 16. More specifically, each boss 44 includes an opening 46 which aligns with an opening 48 formed in a thickened section or boss 50 of sleeve 16 to receive a pivot pin 52. The pivot pin 52 rides in a conventional shaft bearing 54 in aperture 46 and the inner surface 56 of the boss 44 rides on a conventional bearing washer 58 engaged between boss 44 and boss 50. A duplicate structure is provided on the diametrically opposite side of the sleeve or stem tube 16.

As seen in FIG. 7 seal 36 is secured to the end of stem tube 16 by a bolt 60 threaded into the boss 50 and extending into the opening 48. A similar bolt is used to secure the diametrically opposed edge of seal 36 to the other sleeve boss 50. The ends 62 of the two bolts 60 (only one of which is seen in FIG. 7) ride in annular recesses 64 formed in the pivot pins 52 to restrict removal of the pins from the stem tube.

Referring again to FIG. 3, the collar 42 includes one or more (preferably two) radially extending arms 72 which are integral with or rigidly secured to the collar 42 by welding or the like. The outer ends 74 of arms 72 are secured in any convenient manner to reinforcing brackets 76 on the outer surface 78 of nozzle 38.

By the above-described structure, the nozzle 38 is pivoted on the central axis of the pivot pins 52 to move relative to the propeller 32 and direct the flow of water from the propeller to port or starboard to effectuate steering of the vessel with which the system is used.

Preferably, the dimensions of the nozzle are such that the end tips of the propeller closely approach the inner surface of the nozzle throughout the range of motion of the nozzle, and are preferably about one-tenth of an inch spaced therefrom. This structure provides for a continuous column of water moving through the nozzle for improved drive and steering efficiencies.

Figure 8:
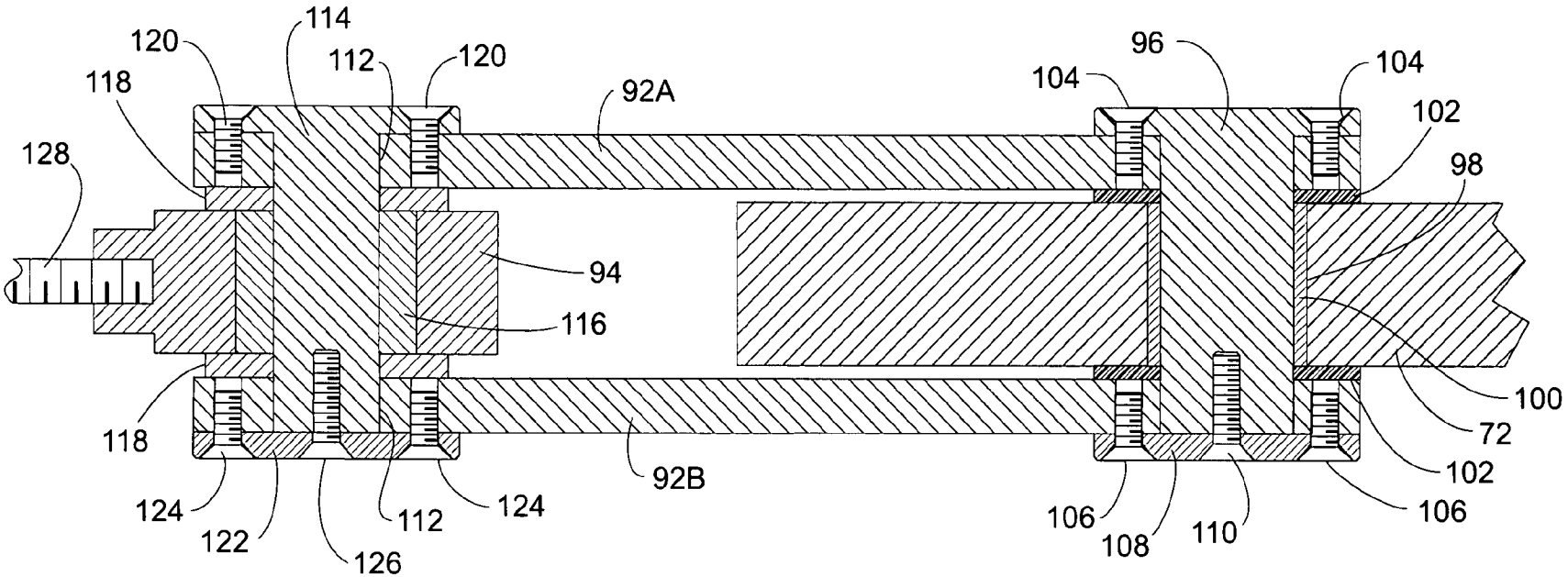
FIG. 8 is a sectional view of the linkage between the control mechanism and nozzle for pivoting the nozzle.
Figure 9:
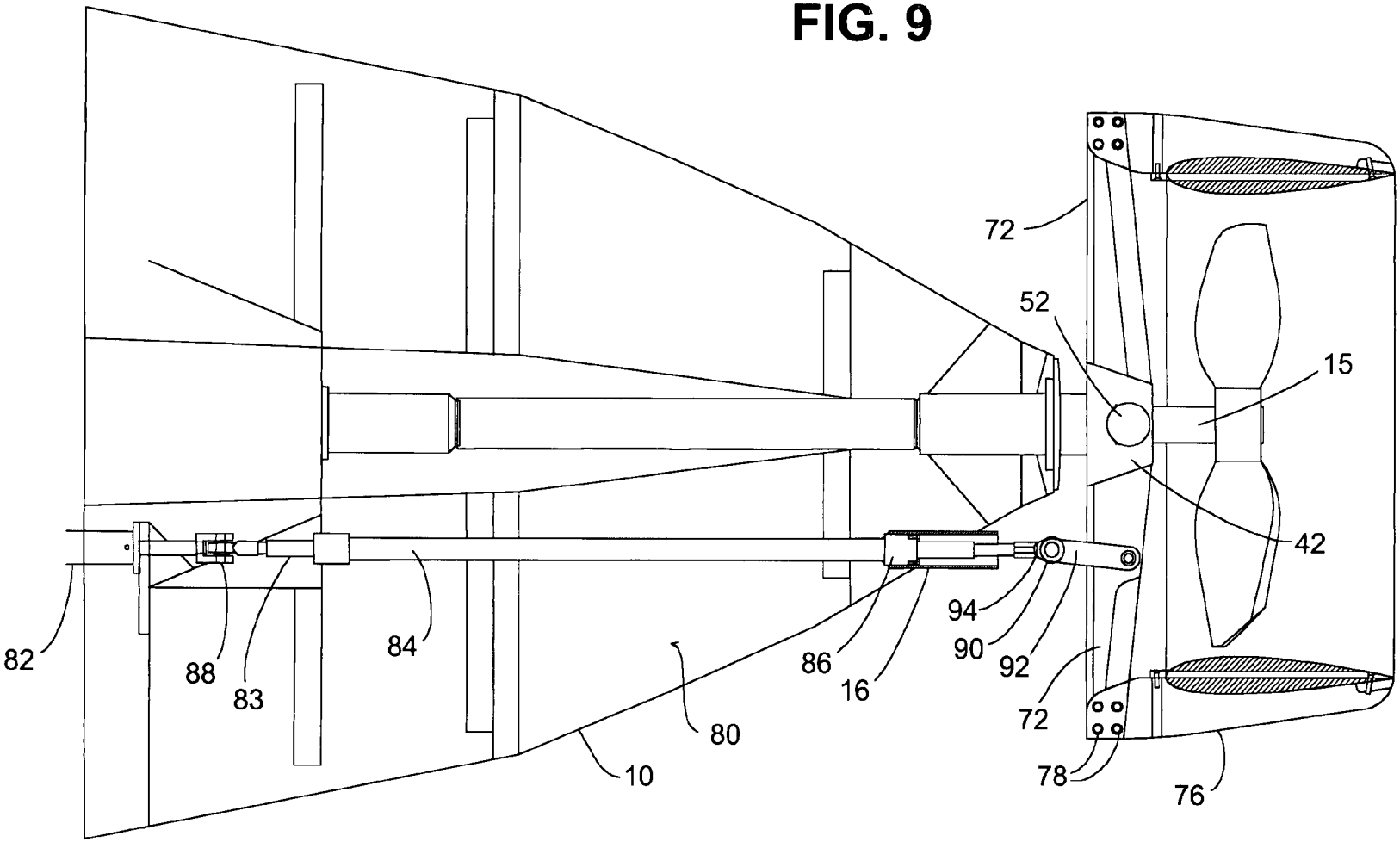
FIG. 9 is a top view with parts in section of the aft portion of the drive pod and the steering mechanism.

Referring now to FIGS. 3, 8 and 9, FIG. 9 shows the two diametrically opposed arms 72 extending from collar 42 and secured to the reinforcing structures 76 by a plurality of bolts 78 or the like at their outer ends 74. As seen therein, a steering control mechanism 80 is provided to push or pull one of the arms 72 to which it is attached about the pivot pins 52 to cause the steering function. In the illustrated embodiment of the invention steering mechanism 80 includes a hydraulic or electronic ram 82 or the like which serves to reciprocate a control rod 83 in the propulsion pod 10. Control rod 83 extends through support tube 84 in the pod and an exit seal 86 of known construction to provide a water tight seal with the hull of the propulsion pod within stem tube 16. One end of control rod 83 is connected to the ram 82 by a pivot coupling 88, and the other end is connected by a pivot 90 to a linkage 92 which is in turn pivotally connected to the adjacent arm 72.

As seen in FIG. 8 the linkage 92 consists of a pair of link arms 92*a* and 92*b* pivotally connected at their ends to the adjacent arm 72 and to a pivot collar 94 of linkage 80.

The pivotal connection between the arms 92*a* and *b* and arm 72 is formed by a pivot pin 96 received in an aperture 98 formed in arm 72. A rotational bearing 100 is also mounted in aperture 98 about the shank of the pivot pin 96. Bearing washers 102 are positioned between the opposed surfaces of the arm 72 and the facing surfaces of the links 92*a* and *b*. The pivot pin 96 is secured to the links by a plurality of screw bolts 104 engaged in link 92*a* and by similar bolts 106 into the link 92*b*. In addition, bolts 106 secure an end cap 108 to the assembly and an additional bolt 110 secures that cap to pin 96. As a result, pin 96 is fixed to the links 92*a* and *b* and rotates in bearing 98 relative to the arm 72. The opposite ends of the arms 92*a* and *b* are connected to collar 94 and receive in their end apertures 112 another pivot pin 114. This pivot pin is secured to arms 92*a* and *b* by a structure similar to that previously described for the pivot pin 96. That is, a bearing sleeve 116 is provided in collar 94 which receives the shank of pivot pin 114 and a pair of bearing washers 118 are positioned between the opposed surfaces of the member 94 and the opposed surfaces of the links 92*a* and 92*b*. The pin is fixed to the link 92*a* against rotation relative thereto by two or more bolts 120. The opposite end of the pin is secured by an end cap 122 and at least a pair of bolts 124 extending from the end cap into the link 92*b*. An additional bolt 126 is secured through end cap 122 into the end of the shank of the pivot pin 114. Here again, pin 114 is held against rotation relative to the link arms but can rotate in bearing 116 within the collar 94. The threaded end 128 of the steering control rod 83 is engaged in collar 94 in a known manner such that reciprocation of the control rod 83 causes arms 72 and thus nozzle 38 to pivot on the pins 52 relative to the propeller.

Although the structure as described above, is sufficient to control the operation and to support nozzle 38, in some applications it may be desirable to provide additional reinforcing or back up support for the nozzle.

As seen in FIG. 3, to this end, a pair of nozzle support arms 140 are provided in the illustrative embodiment which are secured to the aft end of the propulsion module 10. These arms have free ends 142 which are pivotally connected in any convenient manner to the ends 144 of additional support and reinforcing structures 146 mounted on nozzle 38.

Figure 6:
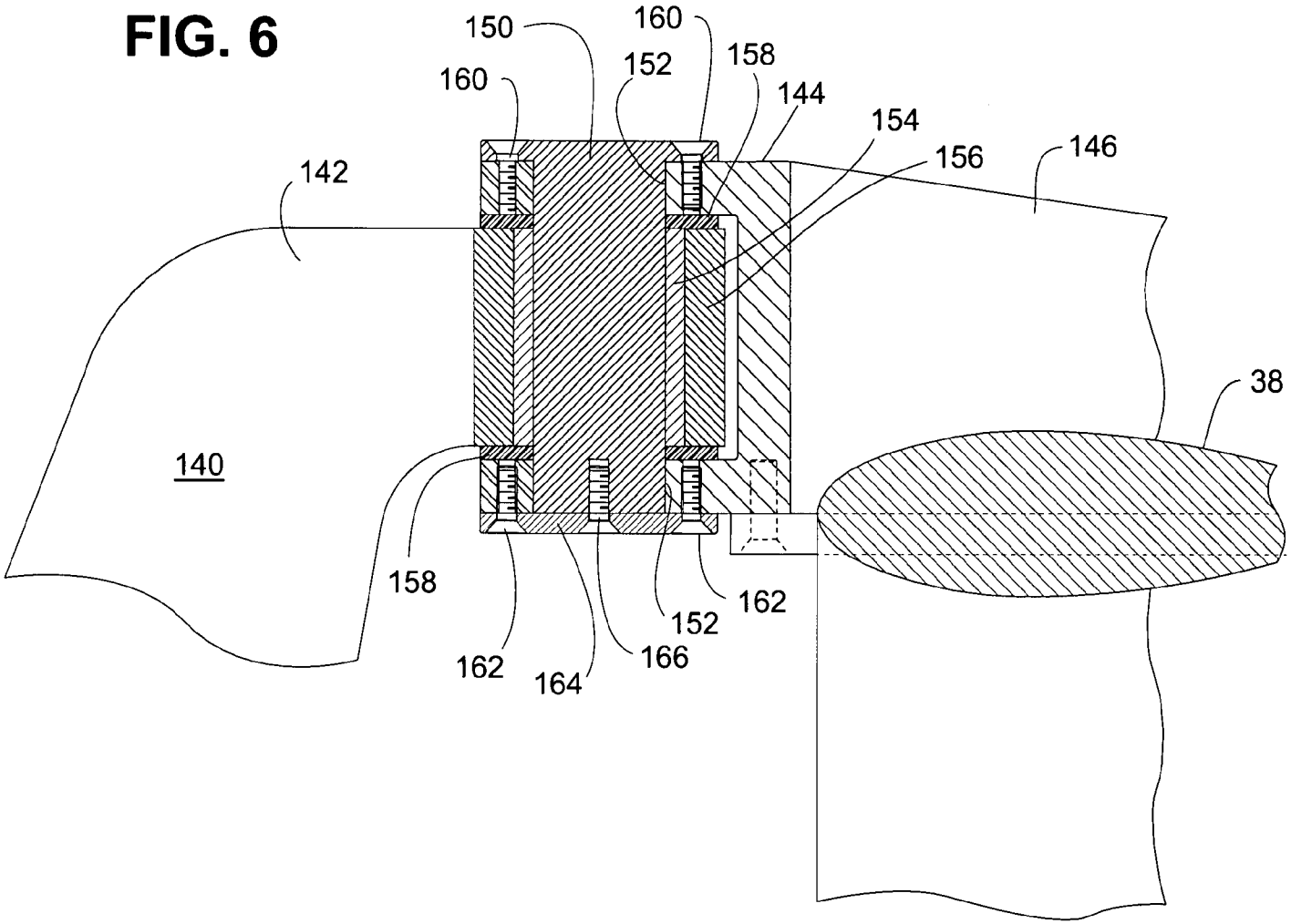
FIG. 6 is an enlarged view partly in section of one pivotal mounting connection for the nozzle.

To accommodate the pivotal movement of the nozzle, the connection of the arm ends 42 and the ends 144 of the reinforcing structures 146 is by a pivotal arrangement similar to the pivotal arrangement used with the steering links 92. Thus, as seen in FIG. 6 a pivot pin 150 is provided that is received in the aligned apertures 152 at the end 144 of the support structure while its shank is received in a bearing sleeve 154 mounted in the cylindrical aperture 156 formed in the end 142 of arm 140. A pair of bearing washers 158 are positioned between the opposed surfaces of the arm end 142. Bolts 160 secure the pin to the upper side of the end 144 of reinforcing structure 146 and on the lower side of end 144, bolts 162 secure an end cap 164 thereto. In addition, a third bolt 166 secures cap 164 to pin 150, so that the pin is held immobile in end 144 of reinforcing member 146 while the arm 140 can pivot with respect thereto. The same structure is used to connect the other arm 140 to the other reinforcing member 146.

The axis of rotation defined by the pivot pin 150 is located to be aligned with the axis of rotation defined by the pivot pins 52 in the collar 42.

As a result of this structure, the nozzle 38 is conveniently mounted for structural support under heavy loads, but easily controlled by the steering assembly.

The steering control linkage described in connection with the accompanying drawings clearly has a limited range of motion, as is typical with all steering assemblies. Preferably, the range of motion is plus or minus 20 degrees to either side of the axis of the drive shaft 14. This is more than adequate to provide steering control for most vessels. However, other ranges of motion could be provided as would be apparent to those skilled in the art As seen most clearly in FIG. 5, the profile structure of the nozzle shell 38 is foil shaped, similar to that of an aircraft wing. Preferably, the profile of the arms 72 and 140 are similarly foil shaped for improved efficiencies of water flow about the structure.

In the illustrative embodiment of the invention reinforcing structures 76 and reinforcing arms 146 are removably mounted on the nozzle in any convenient manner. More in particular, as shown in the drawings, these structures each have an inner surface of 170 which is complimentary to the curved outer surface of the nozzle. An inner mounting plate 172 is provided in association with each of these structures. These mounting plates are received in recesses 178 formed on the inner surface 180 of nozzle 38 and they are bolted at one end by bolts 182 or the like into the ends 144 of the support structures 146 or the ends of the member 76 adjacent the front end of the nozzle. At their rear ends 183 the plates are bolted to rigid support structures 184 secured in the aft end of the nozzle. Thus, by simply removing the various bolts 182, reinforcing members and support arms 76, 146 can be released from the nozzle which can then be readily removed from the structure.

Although the present invention has been described herein connection with a particular preferred embodiment, it is to be understood that the invention is not limited to such embodiment and that various changes and modifications may be effected therein without departing from the scope or spirit of this invention.

What is claimed is:

1. A marine propulsion steering apparatus comprising:

a steering nozzle having a central opening therethrough adapted to surround a marine propulsion drive shaft and propeller extending from a hull, means for pivotally mounting said nozzle on said drive shaft for angular movement in a predetermined range of movement relative to the propeller it surrounds for directing water flow from said propeller; and means for pivoting said nozzle within said range of motion;

said means for pivotally mounting said nozzle including an elongated shaft support tube adapted to be secured to a hull and surrounding the drive shaft, a collar pivotally mounted on said shaft support tube on an axis which extends perpendicular to said tube and at least one support arm connected between said collar and said nozzle.

2. A marine propulsion steering apparatus as defined in claim 1 wherein said at least one arm comprises a pair of arms extending perpendicularly from said collar and connected to said nozzle.

3. A marine propulsion steering system comprising:

a generally ring shaped nozzle having a central opening therethrough and a depth in the fore and aft direction sufficient to surround a marine propeller and its associated shaft extending from a hull;

said nozzle having a cross-sectional configuration throughout its periphery which is generally foil shaped;

a shaft mounting sleeve adapted to be secured to said hull and rotatably contain the drive shaft for said propeller;

a mounting collar pivotally mounted on said sleeve aft of the hull and forward of the propeller for pivotal movement about an axis perpendicular to the sleeve;

means for connecting said mounting collar to said nozzle whereby the nozzle will pivot about said axis perpendicular to said sleeve with the collar; and means for pivoting said collar thereby to cause the nozzle to deflect water ejected from the propeller to create a steering force.

4. A marine propulsion steering system as defined in claim 3 wherein said axis perpendicular to said sleeve on which said collar is mounted is located in the generally vertical direction relative to the direction of travel of the propeller.

5. A marine propulsion steering system as defined in claim 3 wherein said means for connecting said collar to said nozzle comprises a pair of radially extending support arms connected at one end to the collar and at their opposite ends to said nozzle.

6. A marine propulsion steering system as defined in claim 5 wherein said arms lie in substantially the same plane on the port and starboard sides of the sleeve respectively.

7. A marine propulsion steering system as defined in claim 6 including a second pair of support arms lying in a plane perpendicular to the first mentioned pair of arms and each having one end adapted to be secured to the hull and opposite free ends pivotally connected to said nozzle on the same axis as that on which the collar is pivotally mounted on said sleeve.

8. A marine propulsion steering system as defined in claim 3 wherein said means of pivoting said collar comprises a mechanical linkage connected at one end to said connecting means and adapted to be connected at its other end to said hull.

9. A marine propulsion steering system as defined in claim 6 wherein said means for pivoting said collar comprises a mechanical linkage connected at one end to one of said arms and at its other end to said hull.

10. A marine propulsion steering system as defined in claim 9 wherein said mechanical linkage includes a hydraulic ram.

* * * * *